US008664854B2

(12) United States Patent
Kumar et al.

(10) Patent No.: US 8,664,854 B2
(45) Date of Patent: Mar. 4, 2014

(54) AMALGAM TIP TEMPERATURE CONTROL FOR AN ELECTRODELESS LAMP

(75) Inventors: Nitin Kumar, Burlington, MA (US); Robert Martin, Nicholasville, KY (US); Shashank Bakre, Woburn, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 277 days.

(21) Appl. No.: 13/278,263

(22) Filed: Oct. 21, 2011

(65) Prior Publication Data

US 2013/0099664 A1 Apr. 25, 2013

(51) Int. Cl.
*H01J 1/20* (2006.01)
*H01J 19/40* (2006.01)

(52) U.S. Cl.
USPC ..... 313/547; 313/550

(58) Field of Classification Search
USPC ..... 315/32, 39, 39.3, 39.71, 39.77, 70–71, 315/248; 313/160–161, 545–547, 550–552
See application file for complete search history.

(56) References Cited

U.S. PATENT DOCUMENTS

| | | | | |
|---|---|---|---|---|
| 5,629,584 | A * | 5/1997 | Borowiec et al. | 313/565 |
| 7,205,723 | B2 * | 4/2007 | Kurachi et al. | 313/631 |
| 2009/0065413 | A1 | 3/2009 | Fraser et al. | |

FOREIGN PATENT DOCUMENTS

| | | | |
|---|---|---|---|
| CN | 2013599992 | Y * | 1/2009 |
| CN | 201 359 992 | Y | 12/2009 |
| EP | 0 910 112 | A2 | 4/1999 |
| EP | 1 298 702 | A2 | 4/2003 |
| JP | 2010 080241 | A | 4/2010 |

OTHER PUBLICATIONS

Thomas Lang, International Search Report and Written Opinion of the International Searching Authority for PCT/US12/59350, Feb. 7, 2013, pp. 1-12, European Patent Office, Rijswijk, The Netherlands.
Patent Abstracts of Japan—European Patent Office—Translation of Title and Abstract for JP 2010 080241, p. 1, Japanese Patent Office (as provided by European Patent Office with above referenced International Search Report).
XP-002690961—AN 2010-A20003, Database WPI, p. 1, Thomson Scientific, London, United Kingdom (as provided by European Patent Office with above referenced International Search Report).

* cited by examiner

*Primary Examiner* — Minh D A
(74) *Attorney, Agent, or Firm* — Shaun P. Montana

(57) ABSTRACT

A electrodeless lamp including a fluorescent discharge vessel, a tip, an amalgam, a lamp core, and a heater. The vessel contains a gas having a partial vapor pressure and a fluorescent material. The tip has an inner end engaging the vessel, and an opening in communication with the gas. The amalgam is positioned within the opening, in heat transfer relation with the tip. When the temperature of the amalgam decreases, mercury vapor in the gas condensates onto the amalgam, causing a decrease in the partial vapor pressure of the gas. The opposite occurs when the amalgam temperature increases. The lamp core generates a magnetic flux, causing an electrical discharge in the gas. The heater includes a positive temperature coefficient connected to a winding of the lamp core. The heater is in heat transfer relation with the tip and heats the tip when the electrodeless lamp is in a dimming mode.

11 Claims, 6 Drawing Sheets

AMALGAM TIP TEMPERATURE CONTROL FOR AN ELECTRODELESS LAMP

TECHNICAL FIELD

The present invention relates to lighting, and more specifically, to temperature control of an amalgam tip in a discharge lamp.

BACKGROUND

Power applied to an electrodeless lamp including mercury is dissipated as discharge power and high frequency coupler losses. The high frequency coupler losses increase with increasing lamp voltage. The lamp voltage increases with decreasing discharge power. When dimming an electrodeless lamp including mercury, the lamp power and the discharge power are reduced. Thus, the lamp voltage increases, increasing the high frequency coupler losses.

SUMMARY

As an electrodeless lamp including mercury is dimmed, the discharge power decreases more rapidly than the lamp power. For a given lamp power, the discharge power will be proportionally lower when in a dimming mode as compared to full light operation. This limits the amount of dimming that may be achieved. At a certain point, the discharge power may become too low to be able to sustain the inductive plasma and the discharge will extinguish.

Embodiments control the partial mercury vapor pressure within an electrodeless lamp including mercury by controlling the temperature of the lamp's coldest spot, to enable lower power operation and good lumen maintenance when dimming the lamp. More particularly, embodiments heat an amalgam positioned with a tip associated with the discharge vessel of the lamp. The amalgam is in heat transfer relation with the tip. The tip is positioned relative to the vessel such that mercury vapor diffuses from the fluorescent discharge vessel to the amalgam and condenses on the amalgam when the temperature of the amalgam decreases. The tip is also positioned relative to the vessel such that the mercury vapor diffuses from the amalgam into the fluorescent discharge vessel when the temperature of the amalgam increases. A lamp core, engaging the discharge vessel, generates a magnetic flux that induces a voltage in the lamp to produce an electrical discharge in the gas. A positive temperature coefficient element is in heat transfer relation with the tip, with the element being electrically connected to a winding of the lamp core. In operation, the lamp core applies a voltage to the element that energizes the element when the lamp core is energized.

In an embodiment, there is provided an electrodeless lamp. The electrodeless lamp includes: a fluorescent discharge vessel containing a gas having a partial mercury vapor pressure and a fluorescent material; a tip having an outer end and an inner end, the inner end engaging the discharge vessel and having an opening in communication with the gas in the discharge vessel; an amalgam positioned within the opening in the tip, the amalgam being in heat transfer relation with the tip, the tip positioned relative to the vessel such that mercury vapor in the gas in the fluorescent discharge vessel condensates onto the amalgam when the temperature of the amalgam decreases, thereby causing a decrease in the partial mercury vapor pressure within the discharge vessel, the tip positioned relative to the vessel such that the gas diffuses from the amalgam into the fluorescent discharge vessel when the temperature of the amalgam increases, thereby causing an increase in the partial mercury vapor pressure within with discharge vessel; a lamp core capable of connection to a power source, the lamp core engaging the discharge vessel, wherein the lamp core generates a magnetic flux when powered by a connected power source, wherein the magnetic flux induces a voltage and a current in the fluorescent discharge vessel to produce an electrical discharge in the gas; and a heater capable of connection to the power source, wherein the heater is in heat transfer relation with the tip, such that the heater heats the tip when the electrodeless lamp is in a dimming mode, wherein the heater comprises a positive temperature coefficient ("PTC") element in heat transfer relation with the tip, the PTC element electrically connected to a winding of the lamp core, the lamp core applying a voltage to the PTC element to power the PTC element when the lamp core is powered.

In a related embodiment, the electrodeless lamp may further include an enclosure that may receive the outer end of the tip and may be in heat transfer relation with the outer end of the tip, the enclosure may further be in heat transfer relation with the PTC element so that heat generated by the PTC element may be transferred to the tip via the enclosure.

In a further related embodiment, the enclosure may include a slot configured to receive the PTC element.

In a further related embodiment, the PTC element may be located within the slot. In a further related embodiment, the PTC element may include a first terminal having a first face and a second face and a second terminal having a third face and a fourth face, wherein a first polymer disc may be positioned between the first face and a first wall of the slot, and wherein a second polymer disc may be positioned between the fourth face and a second wall of the slot, the first disc and second disc may be in heat transfer relation between the PTC element and the enclosure, the first disc and the second disc may be electrically insulating the first terminal and the second terminal relative to the enclosure.

In another further related embodiment, the lamp core may include a primary winding including one or more turns of wire wound around a magnetic core, and the PTC element may be electrically connected to a secondary winding wound around the lamp core. In a further related embodiment, the electrical discharge may have a negative voltage-current curve such that when the power supplied to the lamp core decreases, the voltage applied to the PTC element by the secondary winding of the lamp core increases and the temperature of the PTC element increases, and when the power supplied to the lamp core increases, the voltage applied to the PTC element by the secondary winding of the lamp core decreases and the temperature of the PTC element decreases.

In another further related embodiment, the enclosure may include an opening to an interior space within the enclosure and a cap configured to engage the opening, the PTC element may be positioned in the interior space and the cap may be positioned within the opening to retain the PTC element. In a further related embodiment, the enclosure may include an aluminum cylinder.

In yet another related embodiment, the tip may be positioned relative to the vessel such that mercury vapor condensates onto the amalgam from the fluorescent discharge vessel when the temperature of the amalgam decreases.

In another embodiment, there is provided an electrodeless lamp system having a dimming mode in which reduced power is supplied thereto. The electrodeless lamp system includes: a power supply for connection to a power source; and an electrodeless lamp. The electrodeless lamp includes: a fluorescent discharge vessel containing a gas having a partial mercury vapor pressure and a fluorescent material; a tip having an outer end and an inner end, the inner end engaging the discharge vessel and having an opening in communication with the gas in the discharge vessel; an amalgam positioned within the opening in the tip, the amalgam being in heat transfer relation with the tip, the tip positioned relative to the vessel such that mercury vapor in the gas in the fluorescent discharge vessel condensates onto the amalgam when the temperature of the amalgam decreases, thereby causing a decrease in the partial mercury vapor pressure within the discharge vessel, the tip positioned relative to the vessel such that the gas diffuses from the amalgam into the fluorescent discharge vessel when the temperature of the amalgam increases, thereby causing an increase in the partial mercury vapor pressure within with discharge vessel; a lamp core capable of connection to a power source, the lamp core engaging the discharge vessel, wherein the lamp core generates a magnetic flux when powered by a connected power source, wherein the magnetic flux induces a voltage and a current in the fluorescent discharge vessel to produce an electrical discharge in the gas; and a heater capable of connection to the power source, wherein the heater is in heat transfer relation with the tip, such that the heater heats the tip when the electrodeless lamp is in a dimming mode, wherein the heater comprises a positive temperature coefficient ("PTC") element in heat transfer relation with the tip, the PTC element electrically connected to a winding of the lamp core, the lamp core applying a voltage to the PTC element to power the PTC element when the lamp core is powered.

In a related embodiment, the lamp core may include a primary winding comprising one or more turns of wire wound around a magnetic core, and the PTC element may be electrically connected to a secondary winding wound around the lamp core. In a further related embodiment, the electrodeless lamp system may further include an enclosure configured to receive the outer end of the amalgam tip, the enclosure being in heat transfer relation with the PTC element upon receiving the outer end of the amalgam tip. In a further related embodiment, the enclosure may receive the outer end of the amalgam tip and the enclosure may be in heat transfer relation with the outer end of the tip, the enclosure may include a slot with an opening configured to receive the PTC element, the PTC element may be located therein in heat transfer relation with the enclosure, such that heat generated by the PTC element is transferred to the tip via the enclosure. In a further related embodiment, the PTC element may include a first terminal having a first face and a second face and a second terminal having a third face and a fourth face, wherein a first polymer disc may be positioned between the first face from a wall of the slot, and wherein a second polymer disc may be positioned between the fourth face and another wall of the slot, the first polymer disc and the second polymer disc may be in heat transfer relation between the PTC element and the enclosure, the first polymer disc and the second polymer disc electrically insulating the first terminal and the second terminal from the enclosure.

In another further related embodiment, the electrical discharge may have a negative voltage-current curve such that when the power supplied to the lamp core decreases, the voltage applied to the PTC element by the secondary winding of the lamp core increases and the temperature of the PTC element increases, and when the power supplied to the lamp core increases, the voltage applied to the PTC element by the secondary winding of the lamp core decreases and the temperature of the PTC element decreases.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
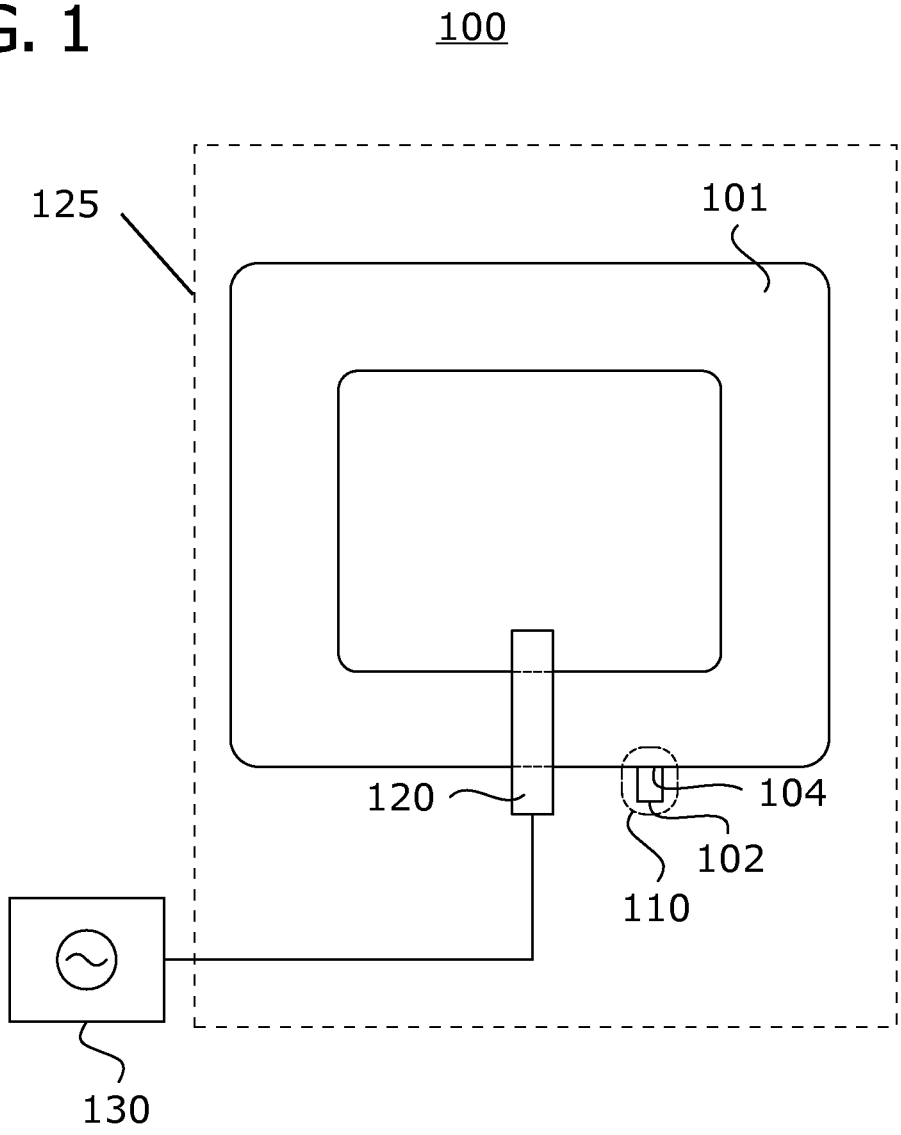
FIG. 1 shows an electrodeless lamp system according to embodiments described herein.

FIG. 1 shows a system 100 including a lamp 125 and a power supply 130. The lamp 125 includes a fluorescent discharge vessel 101 with a tip 110. The tip 110 includes a first end 102 and a second end 104. The fluorescent discharge vessel 101 contains a gas having a partial mercury vapor pressure and a fluorescent material. The lamp 125 also includes a lamp core 120 engaging the fluorescent discharge vessel 101. The lamp core 120 is connected to the power supply 130, which is energized by a power source. In some embodiments, the power supply 130 comprises a ballast supplying alternating current ("AC") to the lamp core 120. In such configurations, the fluorescent discharge vessel 101 and the lamp core 120 act as a transformer, with the electrical windings (see element 307 in FIG. 4) of the lamp core 120 being the primary windings and the fluorescent discharge vessel 101 being a one-turn secondary winding. As such, the voltage present on the electrical windings of the lamp core 120 is directly related to the discharge voltage present within the lamp 125 during operation thereof. When energized, the power supply 130 supplies alternating current through the electrical windings of the lamp core 120. The discharge within the fluorescent discharge vessel 101 has a negative voltage-current curve. In some embodiments, the power supply 130 is a current controlled supply, while in others the power supply 130 provides variable power to the lamp core 120.

Figure 2:
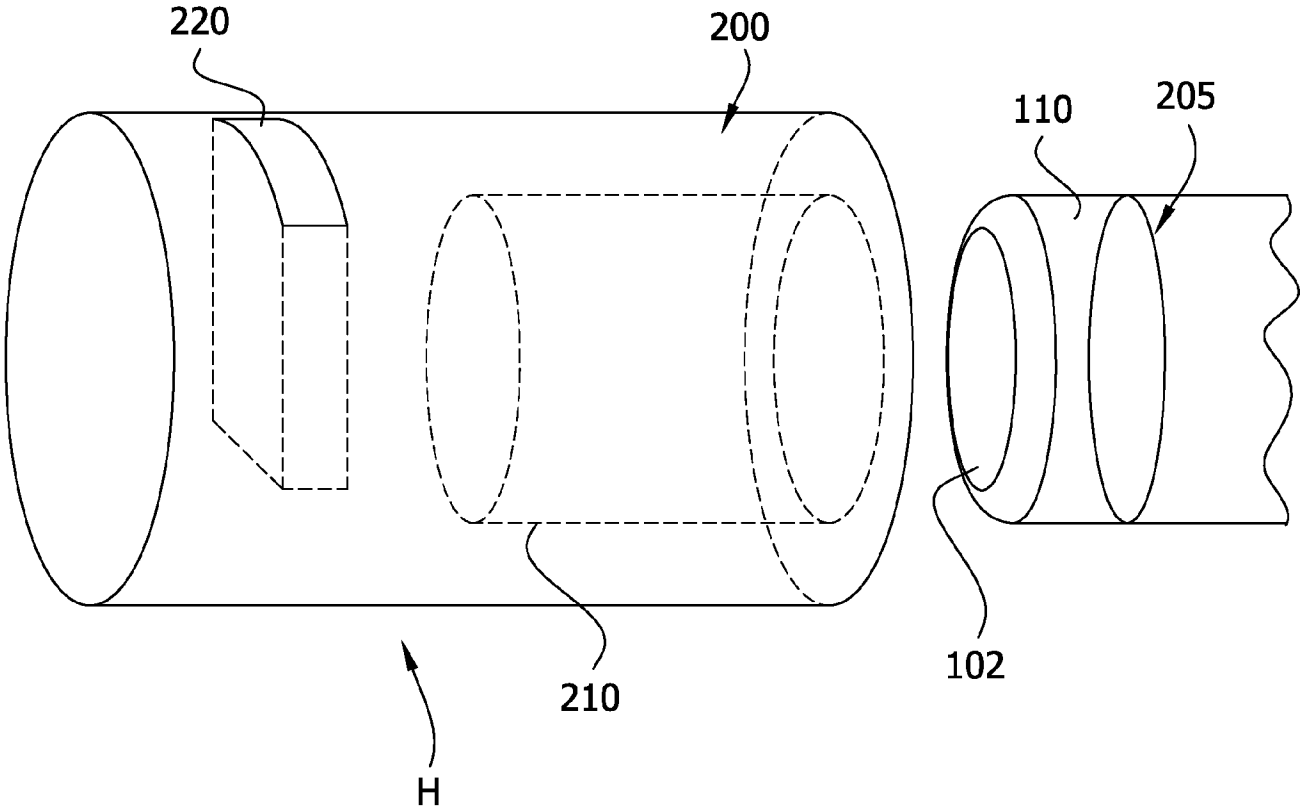
FIG. 2 shows a tip with an amalgam positioned therein and an enclosure according to embodiments described herein.

FIG. 2 illustrates a heater H in heat transfer relation with the tip 110 of the lamp 125 shown in FIG. 1. In some embodiments, such as is shown in FIG. 2, the heater H may be an enclosure 200, with the enclosure 200 configured to receive the first end 102 of the tip 110. The first end 102 of the tip 110 is closed and is positioned outside the fluorescent discharge vessel 101. The second end 104 of the tip 110 is positioned within the fluorescent discharge vessel 101 and defines an opening. In some embodiments, the second end 104 of the tip 110 is positioned within the fluorescent discharge vessel 101 and the first end 102 of the tip 110 extends beyond the fluorescent discharge vessel 101. Alternatively, or additionally, in some embodiments, the second end 104 of the tip 110 may be integral with the fluorescent discharge vessel 101. An amalgam 205, which may be but is not limited to mercury in combination with one or more other metals, is positioned within the tip 110 and is in heat transfer relation with the tip 110. The enclosure 200 is configured to accept the first end 102 of the tip 110 into a cavity 210 of the enclosure 200 so that the enclosure 200 is in heat transfer relation with the tip 110. The enclosure 200 is further configured to be in heat transfer relation with an element that generates heat (not shown in FIG. 2). For example, a slot 220 of the enclosure 200 may receive the element.

In some embodiments, the amalgam 205 is positioned within the opening in the tip 110, which will allow mercury vapor to diffuse from the amalgam 205 into the gas in the fluorescent discharge vessel 101 when the amalgam 205 is heated. This positioning will also allow mercury vapor in the gas in the fluorescent discharge vessel 101 to condense on the amalgam 205 when the amalgam 205 cools. In some embodiments, the amalgam 205 comprises mercury and one or more metals, such as but not limited to copper, indium, tin, bismuth, and/or zinc. In some embodiments, the tip 110 may be but is not limited to a glass tube.

Figure 3:
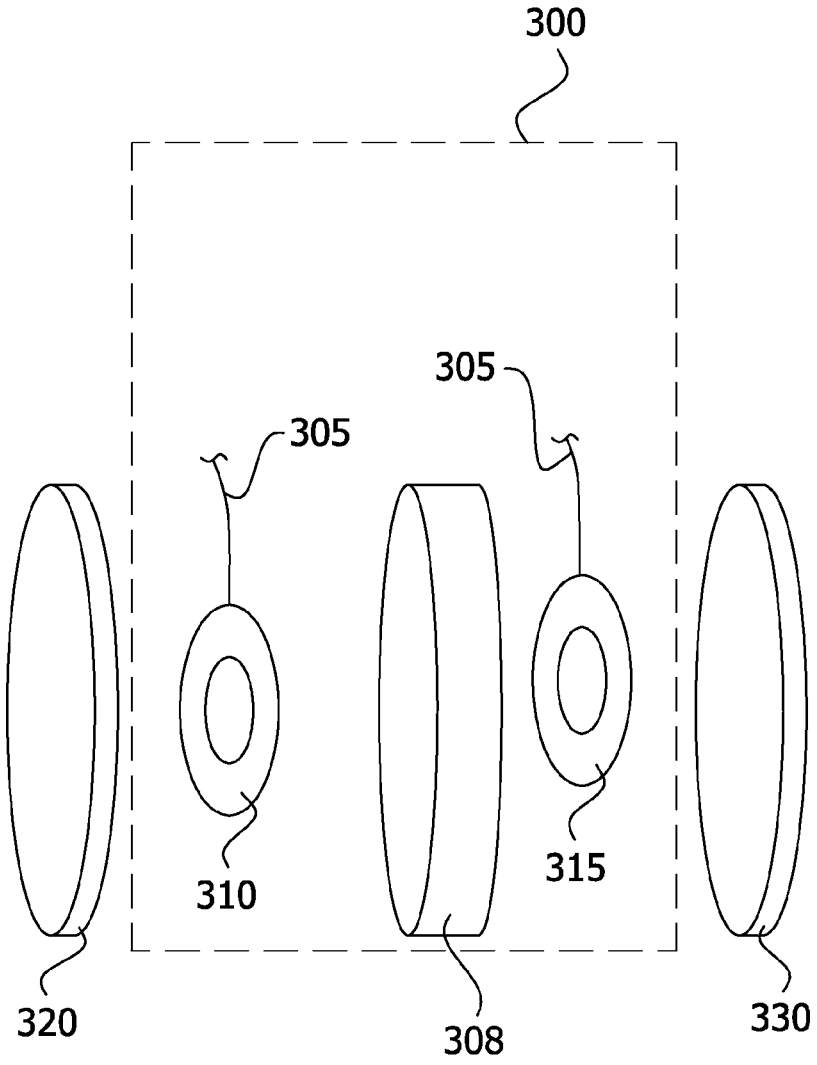
FIG. 3 shows a positive temperature coefficient element configuration according to embodiments described herein.

FIG. 3 illustrates an embodiment of an element 300 that generates heat as a positive temperature coefficient ("PTC"). The element 300 comprises a PTC thermistor, which is a resistive element having a temperature directly proportional to the voltage applied to the element 300. The element 300 is thus also referred to herein as a PTC element 300. The PTC element 300 is in heat transfer relation with the enclosure 200 (see FIG. 4). The PTC element 300 as shown in FIG. 3 includes a wire loop 305, a first terminal 310, and a second terminal 315, separated by and in electrical contact with opposite sides of a PTC material 308. In some embodiments, the first terminal 310 and the second terminal 315 are electrically insulated from the enclosure 200 (which may be an electrically conductive material, such as a metal) by electrically insulating material 320 and/or 330. The electrically insulating materials 320 and/or 330 may comprise any materials suited for electrical insulation, including but not limited to one of more discs of polymer compounds that transfer heat from the PTC material 308 to the enclosure 200.

Figure 4:
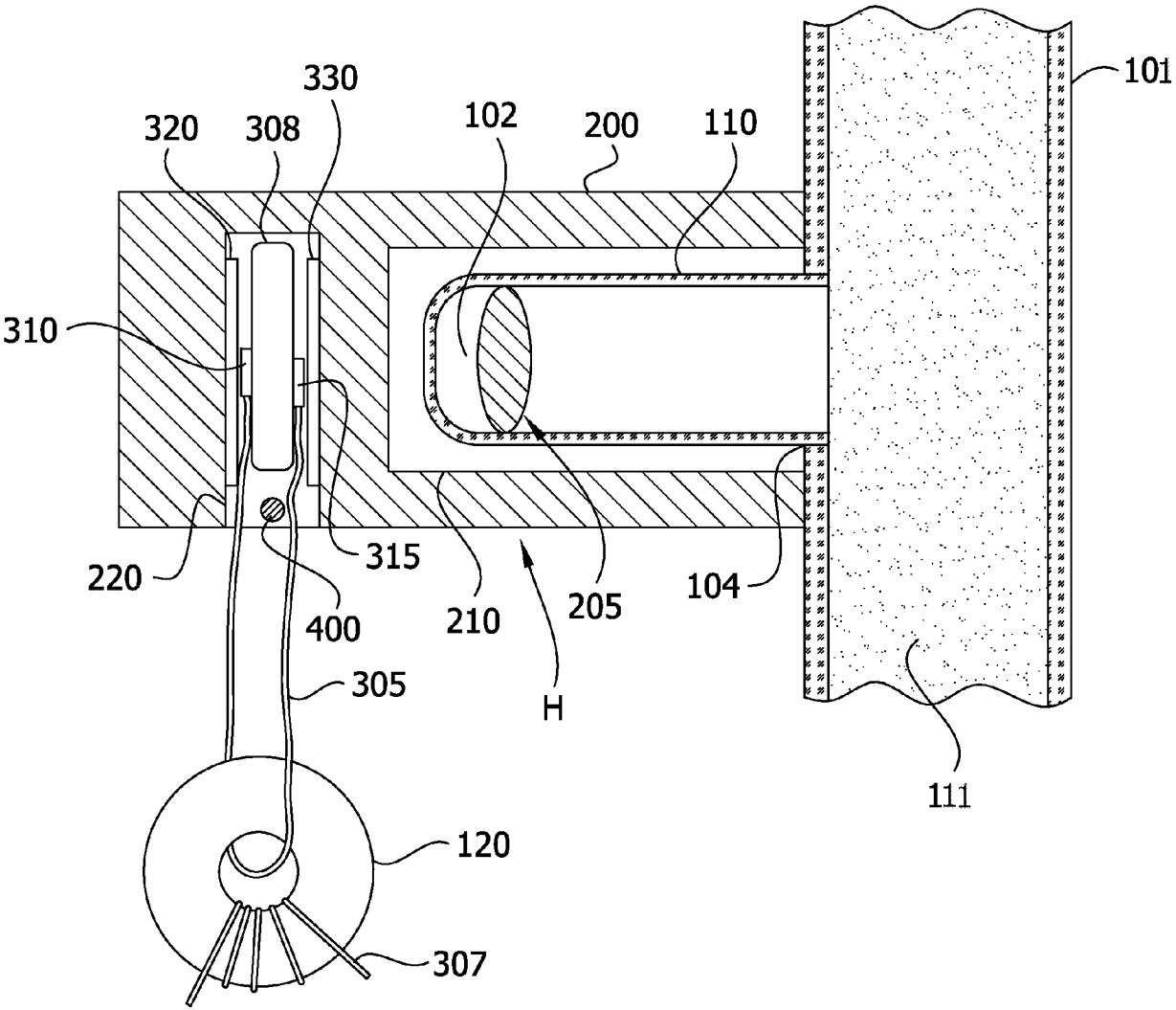
FIG. 4 shows a tip, an enclosure, a positive temperature coefficient element, and a vessel, each in cross-section, according to embodiments described herein.

FIG. 4 illustrates an embodiment that includes the elements shown in FIGS. 2 and 3. The slot 220 receives the PTC element, including the first terminal 310 and the second terminal 315 separated by and in electrical contact with the PTC material 308. The first terminal 310 and the second terminal 315 are electrically insulated from the enclosure 200 by the insulating materials 320 and 330, respectively. The cavity 210 receives the first end 102 of the tip 110 thereby placing the enclosure 200 in heat transfer relation with the tip 110. In some embodiments, the PTC element is electrically connected to one or more windings of the lamp core 120 (see FIG. 1). In some embodiments, a wire loop 305, as a secondary winding magnetically coupled to a primary winding 307, is added to the lamp core 120 (see FIG. 1) as an additional one turn winding. Alternatively, or additionally, the wire loop 305 may be added to the lamp core 120 as two or more turns. As shown in FIG. 4, the PTC element is positioned within the slot 220. In some embodiments, the slot 220 includes a retention block or paste 400 inserted within the opening of the slot 220, in order to make sure that the PTC element is retained within the slot 220. In some embodiments, the heat transfer relation between the PTC element and the enclosure 200 is effected by the PTC element heating the air within the slot 220, thereby heating the walls of the slot 220, which then transfers heat to the enclosure 200.

During operation of the lamp 125, the power supply 130 supplies AC power to the electrical windings of the lamp core 120. A magnetic flux is generated in the lamp core 120 and is applied to the fluorescent discharge vessel 101, which induces a voltage within the fluorescent discharge vessel 101. This voltage accelerates electrons within a gas 111 within the fluorescent discharge vessel 101 to create an electrical discharge, which causes the fluorescent material in the gas 111 to fluoresce. In this configuration, the fluorescent discharge vessel 101 and the lamp core 120 effectively form a transformer, with the primary windings 307 acting as the primary side of the transformer and the fluorescent discharge vessel 101 acting as secondary side of the transformer. As is known in the art, inductance is directly proportional to the square of the number of turns (of electrical wire) around a magnetic core. Inductance is determined using the equation $L_{core}=(N^2)*L_0$, where $L_{core}$ is the inductance of the wound core, N is the number of turns, and $L_0$ is the 1 turn inductance of the core and is proportional to the core permeability and size.

One alternative to the lamp 125 illustrated in FIG. 1 is to have two lamp cores surrounding the fluorescent discharge vessel and connected in parallel with the power supply. Both lamp cores would have the same number of windings. In this alternative embodiment, the lamp inductance is given by the equation $L_{lamp}=(1/L_{core1}+1/L_{core2})^{-1}$. Since both cores have approximately equal inductance, the lamp inductance is given by the equation $L_{lamp}\approx(2/L_{core})^{-1}$ or $L_{lamp}\approx L_{core}/2$. In other words, the inductance of this lamp is $L_{lamp}\approx N^2*L_0/2$.

The discharge power is a function of the partial mercury vapor pressure, which itself is dependent on temperature. The discharge power goes through a maximum when the partial mercury vapor pressure is varied linearly. The partial mercury vapor pressure at which maximum power is achieved is called the optimum partial mercury vapor pressure. The partial mercury vapor pressure decreases with decreasing temperature of the coldest spot in the discharge vessel.

When dimming an electrodeless mercury-containing fluorescent lamp, e.g., lowering the amount of AC power supplied by the power supply 130 to the lamp core 120, the lamp temperature decreases. As a result, the partial mercury vapor pressure falls below its optimum value. In most cases, the mercury vapor pressure will be near its optimum at full power, so lowering the lamp power and therefore its temperature will reduce the mercury vapor pressure below an optimum pressure. For the same lamp current, if the partial mercury vapor pressure is increased, the discharge power will be increased, the lamp voltage will decrease, and thus high frequency coupler losses will be decreased. This allows lowering the lamp power to lower levels while maintaining the minimum discharge power to sustain the inductive plasma.

As the lamp power is reduced (e.g., as the output of the lamp is dimmed) and the lamp voltage gets too high, the voltage gradient created in the discharge tends to drive mercury molecules into a phosphor coating of the lamp. This damages and darkens the phosphor comprising the phosphor coating, which lowers the efficiency of the phosphor, and reduces transmittance. These both have the effect of lowering lumen output, even at full lamp power, which translates to poor lumen maintenance. By increasing the partial mercury vapor pressure, such as described by embodiments herein, the lamp voltage is reduced and the phosphor damage is reduced to normal levels, and darkening eliminated.

Thus, embodiments increase the temperature of the amalgam 205 by heating the tip 110, which has the effect of diffusing mercury vapor from the amalgam 205 to the gas 111 located in the fluorescent discharge vessel 101 to increase the partial mercury vapor pressure. When the lamp 125 is in a dimming mode, increasing the partial mercury vapor pressure will increase the vapor pressure closer to an optimum pressure value, which will increase discharge power and lower discharge voltage. A lower discharge voltage will lower the voltage across the lamp core 120 and thus lower high frequency losses in the lamp core 120.

As indicated above, in some embodiments, the wire loop 305 is added to the lamp core 120 as a one-turn winding that is magnetically coupled to the "one-turn" secondary winding, i.e., the fluorescent discharge vessel 101. As such, the voltage and the current in the wire loop 305 will vary with the discharge voltage within the fluorescent discharge vessel 101, with the lamp discharge having a negative voltage-current curve. Therefore, as power (and current) supplied to the lamp core 120 decreases during dimming, the discharge current within the fluorescent discharge vessel 101 decreases and the discharge voltage within the fluorescent discharge vessel 101 increases. Since the wire loop 305 is magnetically coupled with the fluorescent discharge vessel 101, the increased discharge voltage induces a higher voltage in the wire loop 305. The higher induced voltage increases the voltage across the PTC material 308 of the PTC element, which increases the PTC element temperature. The increased temperature of the PTC element causes the temperature of the enclosure 200 to increase as well. The enclosure 200 transfers the generated heat from the PTC element to the tip 110, thereby heating the amalgam 205. This heating of the amalgam causes more mercury gas to diffuse from the amalgam 205 into the gas 111 in the fluorescent discharge vessel 101. As a result, the diffused mercury increases the partial mercury vapor pressure within the fluorescent discharge vessel 101, raising its value closer to the optimum partial mercury vapor pressure.

Embodiments control the cold spot temperature by applying increasing levels of heat to the tip as the lamp power is reduced to dim the lamp. In lamps with two or more modes or levels of dimming, a dimming mode in which a lesser power level is applied the lamp requires increased levels of heat to be applied to the tip as compared to a dimming mode in which a power greater than the lesser power level is applied to the lamp. The higher temperatures of the tip at a lesser power level permit dimming the emitted light of the lamp to lower power levels with reliable operation and good lumen maintenance. Embodiments thus provide other benefits not mentioned herein, but which would be apparent in operation.

As illustrated in FIGS. 3 and 4, the PTC element 300 includes a first terminal 310 having a first face and a second face and a second terminal 315 having a third face and a fourth face, where electrically insulating material 320 with good heat transfer characteristics separates the first face from a wall of the slot 220. Electrically insulating material 330 with good heat transfer characteristics separates the fourth face from another wall of the slot 220. In some embodiments, either insulating material 320 or 330 is removed to improve heat transfer from the PTC element 300 to the enclosure 200. In some embodiments, the enclosure 200 is insulated from contact to avoid shock hazard.

Figure 5:
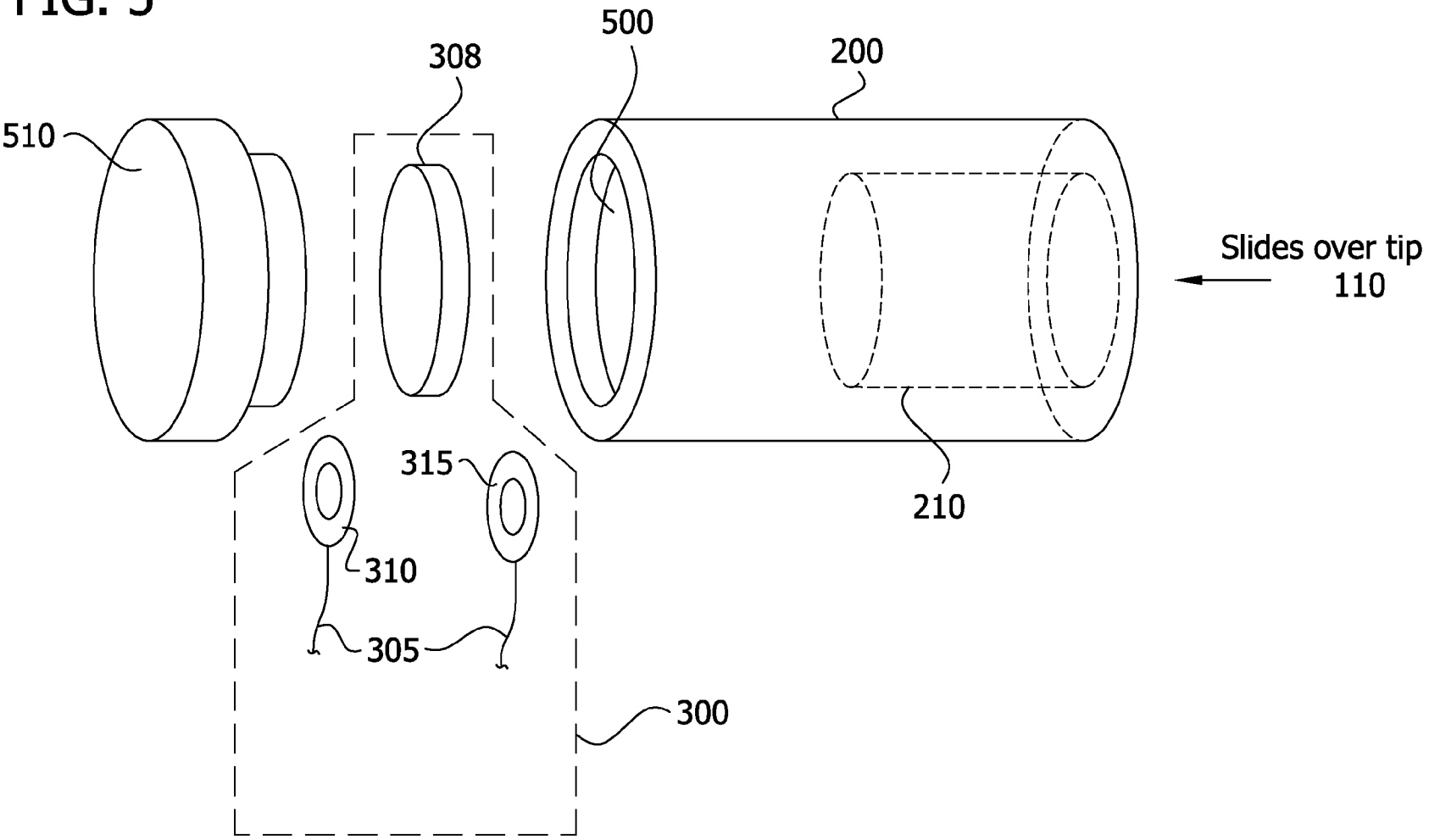
FIG. 5 shows an enclosure and a positive temperature coefficient element according to embodiments described herein.
Figure 6:
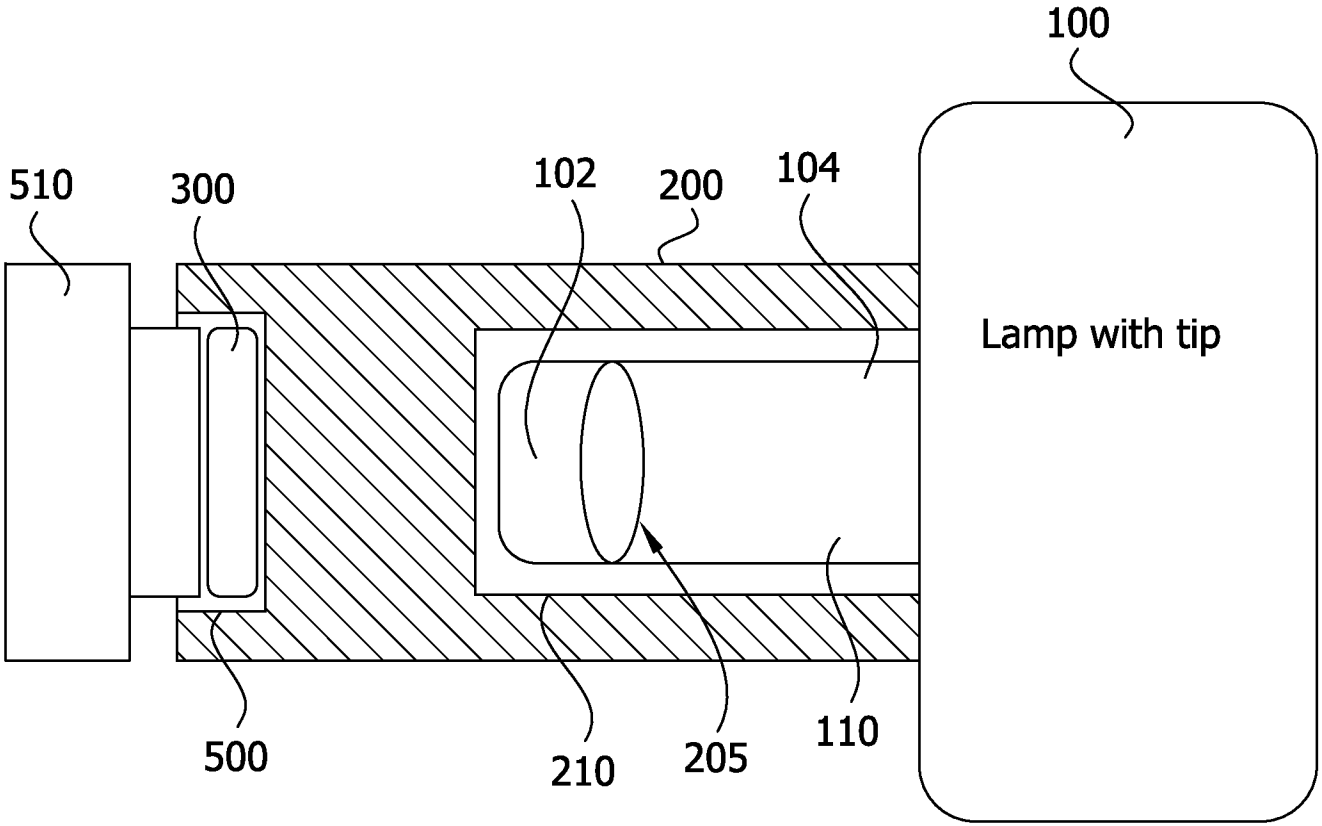
FIG. 6 shows the enclosure illustrated in FIG. 5 positioned over a tip with the enclosure in cross-section, according to embodiments described herein.

FIG. 5 illustrates another embodiment, where the enclosure 200 includes a second cavity 500 in the end opposite of the cavity 210. The second cavity 500 is configured to retain the PTC element 300 within the second cavity 500, with an electrically insulating cap 510 configured to secure the PTC element 300 within the enclosure 200, and in electrical contact with the PTC material 308. In such embodiments, the enclosure 200 must be insulated to avoid shock hazards. When secured, the second terminal 315 is in electrical contact with the PTC material 308 and the PTC material 308 separates the first terminal 310 and the second terminal 315. As such, the PTC element 300 is in heat transfer relation with the enclosure 200 so that heat generated by the PTC element 300 is transferred to the tip 110 via the enclosure 200. In general, the PTC element 300 is in heat transfer relationship to the tip 110 and the enclosure 200 is in heat transfer relationship with both the PTC element 300 and the tip 110 so that the enclosure 200 facilitates heat transfer from the PTC element 300 to the tip 110. In some embodiments, the heat transfer relation between the PTC element 300 and the enclosure 200 is effected by the PTC element 300 heating the air within the second cavity 500, thereby heating the walls of the second cavity 500, which then transfers heat to the enclosure 200. FIG. 6 further illustrates this enclosure positioned over the tip 110.

In some embodiments, the enclosure 200 comprises an aluminum enclosure. In some embodiments, the enclosure 200 comprises any material or materials that enable the transfer of heat. While FIGS. 2, 5, and 6 illustrate a heater including an enclosure, no such enclosure may need to be utilized in other embodiments. In such embodiments, the PTC element 300 is placed adjacent to the tip 110 in heat transfer relation with the tip 110. The PTC element 300 is held in place adjacent the tip 110 by utilizing any suitable electrically insulating and heat-transferring materials and/or methods. In some embodiments, heating may be achieved by utilizing heating elements, other than the PTC element 300, with associated circuitry for diverting and/or deriving power from the wire loop 305 or from other circuitry of the lamp 125.

Table 1 below illustrates electrical measurements performed on an embodiment described herein:

TABLE 1

| $P_{lamp}$ (W) | $V_{rms}$ (V) on 1 Turn |
|---|---|
| 30 | 16.73 |
| 40 | 16 |
| 50 | 15.13 |
| 60 | 14.14 |
| 70 | 12.68 |
| 80 | 11.78 |

In Table 1, "$P_{lamp}$" is a measure of power in watts (W) supplied to a lamp core 120 by a power source 130. "$V_{rms}$ on 1 Turn" is a measure of the voltage (V) in volts present on a single turn of wire of the lamp core, e.g., wire loop 305 added to core 120 in FIG. 4. The measurements in Table 1 demonstrate that reducing the power supplied to the lamp core 120 increases the voltage present on the wire loop 305. As noted above, increasing the voltage supplied to PTC element 300 would, in turn, cause the temperature of the PTC element 300 to proportionally increase as well.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. An electrodeless lamp comprising:

a fluorescent discharge vessel containing a gas having a partial mercury vapor pressure and a fluorescent material;

a tip having an outer end and an inner end, the inner end engaging the discharge vessel and having an opening in communication with the gas in the discharge vessel;

an amalgam positioned within the opening in the tip, the amalgam being in heat transfer relation with the tip, the tip positioned relative to the vessel such that mercury vapor in the gas in the fluorescent discharge vessel condensates onto the amalgam when the temperature of the amalgam decreases, thereby causing a decrease in the partial mercury vapor pressure within the discharge vessel, the tip positioned relative to the vessel such that the gas diffuses from the amalgam into the fluorescent discharge vessel when the temperature of the amalgam increases, thereby causing an increase in the partial mercury vapor pressure within with discharge vessel;

a lamp core capable of connection to a power source, the lamp core engaging the discharge vessel, wherein the lamp core generates a magnetic flux when powered by a connected power source, wherein the magnetic flux induces a voltage and a current in the fluorescent discharge vessel to produce an electrical discharge in the gas; and a heater capable of connection to the power source, wherein the heater is in heat transfer relation with the tip, such that the heater heats the tip when the electrodeless lamp is in a dimming mode, wherein the heater comprises a positive temperature coefficient ("PTC") element in heat transfer relation with the tip, the PTC element electrically connected to a winding of the lamp core, the lamp core applying a voltage to the PTC element to power the PTC element when the lamp core is powered; and an enclosure that receives the outer end of the tip and is in heat transfer relation with the outer end of the tip, the enclosure further being in heat transfer relation with the PTC element so that heat generated by the PTC element is transferred to the tip via the enclosure, wherein the enclosure includes a slot configured to receive the PTC element.

2. The electrodeless lamp of claim 1, wherein the PTC element is located within the slot.

3. The electrodeless lamp of claim 2, wherein the PTC element includes a first terminal having a first face and a second face and a second terminal having a third face and a fourth face, wherein a first polymer disc is positioned between the first face and a first wall of the slot, and wherein a second polymer disc is positioned between the fourth face and a second wall of the slot, the first disc and second disc in heat transfer relation between the PTC element and the enclosure, the first disc and the second disc electrically insulating the first terminal and the second terminal relative to the enclosure.

4. The electrodeless lamp of claim 1, wherein the lamp core includes a primary winding comprising one or more turns of wire wound around a magnetic core, and wherein the PTC element is electrically connected to a secondary winding wound around the lamp core.

5. The electrodeless lamp of claim 4, wherein the electrical discharge has a negative voltage-current curve such that when the power supplied to the lamp core decreases, the voltage applied to the PTC element by the secondary winding of the lamp core increases and the temperature of the PTC element increases, and when the power supplied to the lamp core increases, the voltage applied to the PTC element by the secondary winding of the lamp core decreases and the temperature of the PTC element decreases.

6. The electrodeless lamp of claim 1, wherein the enclosure includes an opening to an interior space within the enclosure and a cap configured to engage the opening, the PTC element positioned in the interior space and the cap positioned within the opening to retain the PTC element.

7. The electrodeless lamp of claim 6, wherein the enclosure comprises an aluminum cylinder.

8. The electrodeless lamp of claim 1, wherein the tip is positioned relative to the vessel such that mercury vapor condensates onto the amalgam from the fluorescent discharge vessel when the temperature of the amalgam decreases.

9. An electrodeless lamp system having a dimming mode in which reduced power is supplied thereto, the lamp system comprising:

a power supply for connection to a power source; and an electrodeless lamp comprising:

a fluorescent discharge vessel containing a gas having a partial mercury vapor pressure and a fluorescent material;

a tip having an outer end and an inner end, the inner end engaging the discharge vessel and having an opening in communication with the gas in the discharge vessel;

an amalgam positioned within the opening in the tip, the amalgam being in heat transfer relation with the tip, the tip positioned relative to the vessel such that mercury vapor in the gas in the fluorescent discharge vessel condensates onto the amalgam when the temperature of the amalgam decreases, thereby causing a decrease in the partial mercury vapor pressure within the discharge vessel, the tip positioned relative to the vessel such that the gas diffuses from the amalgam into the fluorescent discharge vessel when the temperature of the amalgam increases, thereby causing an increase in the partial mercury vapor pressure within with discharge vessel;

a lamp core capable of connection to a power source, the lamp core engaging the discharge vessel, wherein the lamp core generates a magnetic flux when powered by a connected power source, wherein the magnetic flux induces a voltage and a current in the fluorescent discharge vessel to produce an electrical discharge in the gas; and a heater capable of connection to the power source, wherein the heater is in heat transfer relation with the tip, such that the heater heats the tip when the electrodeless lamp is in a dimming mode, wherein the heater comprises a positive temperature coefficient ("PTC") element in heat transfer relation with the tip, the PTC element electrically connected to a winding of the lamp core, the lamp core applying a voltage to the PTC element to power the PTC element when the lamp core is powered;

wherein the lamp core includes a primary winding comprising one or more turns of wire wound around a magnetic core, and wherein the PTC element is electrically connected to a secondary winding wound around the lamp core; and an enclosure configured to receive the outer end of the amalgam tip, the enclosure being in heat transfer relation with the PTC element upon receiving the outer end of the amalgam tip, wherein the enclosure receives the outer end of the amalgam tip and wherein the enclosure is in heat transfer relation with the outer end of the tip, the enclosure including a slot with an opening configured to receive the PTC element, the PTC element being located therein in heat transfer relation with the enclosure, such that heat generated by the PTC element is transferred to the tip via the enclosure.

10. The electrodeless lamp system of claim 9, wherein the PTC element includes a first terminal having a first face and a second face and a second terminal having a third face and a fourth face, wherein a first polymer disc is positioned between the first face from a wall of the slot, and wherein a second polymer disc is positioned between the fourth face and another wall of the slot, the first polymer disc and the second polymer disc in heat transfer relation between the PTC element and the enclosure, the first polymer disc and the second polymer disc electrically insulating the first terminal and the second terminal from the enclosure.

11. The electrodeless lamp system of claim 9, the electrical discharge has a negative voltage-current curve such that when the power supplied to the lamp core decreases, the voltage applied to the PTC element by the secondary winding of the lamp core increases and the temperature of the PTC element increases, and when the power supplied to the lamp core increases, the voltage applied to the PTC element by the secondary winding of the lamp core decreases and the temperature of the PTC element decreases.

* * * * *